US010998614B2

(12) United States Patent
Tomo et al.

(10) Patent No.: US 10,998,614 B2
(45) Date of Patent: May 4, 2021

(54) ULTRA-WIDEBAND ANTENNA

(71) Applicant: NETEERA TECHNOLOGIES LTD., Jerusalem (IL)

(72) Inventors: Uzi Tomo, Jerusalem (IL); Haim Goldberger, Modiin (IL)

(73) Assignee: NETEERA TECHNOLOGIES LTD., Jerusalem (IL)

( * ) Notice: Subject to any disclaimer, the term of this patent is extended or adjusted under 35 U.S.C. 154(b) by 241 days.

(21) Appl. No.: 16/310,832

(22) PCT Filed: May 22, 2018

(86) PCT No.: PCT/IL2018/050555

§ 371 (c)(1),
(2) Date: Dec. 18, 2018

(87) PCT Pub. No.: WO2018/216010

PCT Pub. Date: Nov. 29, 2018

(65) Prior Publication Data

US 2020/0313277 A1 Oct. 1, 2020

Related U.S. Application Data

(60) Provisional application No. 62/510,788, filed on May 25, 2017.

(51) Int. Cl.

| | |
|---|---|
| ***H01Q 1/22*** | (2006.01) |
| ***H01Q 9/28*** | (2006.01) |
| ***H01Q 21/06*** | (2006.01) |

(52) U.S. Cl.
CPC ..... *H01Q 1/2283* (2013.01); *H01Q 9/285* (2013.01); *H01Q 21/062* (2013.01)

(58) Field of Classification Search
CPC ..... H01Q 1/2283; H01Q 9/285; H01Q 21/062
See application file for complete search history.

(56) References Cited

U.S. PATENT DOCUMENTS 3,594,802 A * 7/1971 Koob ..... H01Q 21/20 343/705
5,319,377 A * 6/1994 Thomas ..... H01Q 13/085 343/700 MS (Continued)

OTHER PUBLICATIONS

El Sayed Ahmad Ahmad et al: "Ultra-wideband quasi-Yagi circular dipole antenna for wireless applications", 2013 Loughborough Antennas & Propagation Conference (LAPC), IEEE, Nov. 11, 2013 (Nov. 11, 2013 ), pp. 198-201, XP032550681, DOI: 10.1109/LAPC. 2013.6711882 [retrieved on Jan. 13, 2014].

(Continued)

*Primary Examiner* — Ricardo I Magallanes
(74) *Attorney, Agent, or Firm* — Dorsey & Whitney LLP

(57) ABSTRACT

An antenna pattern integrated-on-chip for transmitting and/or receiving sub-terahertz and terahertz (THZ) signal& The antenna pattern comprising: a first conductor having a bi-circular structure; a second conductor having a bi-circular structure connected to the first bi-circular structure. The bi-circular structures comprising a first conductive circular lobe having a radius (Rx) and a second circular lobe having a radius (Rc), such that said Rx≥Rc. The first bi-circular and the second bi-circular characterized by at least one port thereby, having an area of intersection between the first bi-circular and the second lei-circular, forming an ultra-wideband (UWB) frequency response of more than about 100% bandwidth.

19 Claims, 7 Drawing Sheets

(56) References Cited

U.S. PATENT DOCUMENTS

| | | | | |
|---|---|---|---|---|
| 2004/0130499 | A1* | 7/2004 | Weiss | H01Q 9/285 343/795 |
| 2004/0217912 | A1* | 11/2004 | Mohammadian | H01Q 13/085 343/795 |
| 2007/0290939 | A1 | 12/2007 | Teshirogi et al. | |

OTHER PUBLICATIONS

Nguyen Ngoc Mai Khanh et al: "A CMOS Pulse Beamforming Transmitter Design with an On-Chip Antenna Array for Millimeter Wave Imaging Applications", Future Information Technology (FUTURETECH), 2010 5th International Conference on, IEEE, Piscataway, NJ, USA, May 21, 2010 (May 21, 2010), pp. 1-6, XP031688313, ISBN: 978-1-4244-6948-2.

Schantz H G et al: "UWB planar bulbous dipole antennas", Antennas and Propagation Society Symposium, 2005, IEEE Washington, DC, Jul. 3-8, 2005, Piscataway, NJ: IEEE, US, vol. 2A, Jul. 3, 2005 (Jul. 3, 2005), pp. 475-473, XP010858312, DOI: 10.1109/APS.2005.1551848 ISBN 978-0-7803-8883-3.

* cited by examiner

ULTRA-WIDEBAND ANTENNA

RELATED APPLICATIONS

This application claims priority from PCT Application Number PCT/IL2018/050555, filed on May 22, 2018, which claims priority from provisional application No. 62/510,788 filed on May 25, 2017, both of which are incorporated herein by reference.

FIELD OF INVENTION

The present invention pertains generally to electromagnetic enemy radiation, transmission and or reception of electromagnetic energy or signals.

More particularity, the present invention provides an antenna having a geometric pattern providing ultra-wideband (UWB) adjacent to a variety of frequencies.

BACKGROUND OF THE INVENTION

A dipole antenna is known to have limited bandwidth resulting from a reduced ability to transmit or receive significant amounts of information.

Antennas having ultra-wide band (UWB) properties are desired for a variety of applications, including impulse radio applications fir communications, positioning, and other uses. Historically the principal use of UWB antennas has been in multi-band communication systems. Such multi-band communication systems require an ultra-wide band antenna that can handle narrow band signals at a variety of frequencies.

A variety of technologies includes antenna having different structure such as isotropic antenna, monopole antenna, dipole antenna, aperture antenna, loop antenna and the like.

The bow-tie antenna is a dipole with flaring, triangular shaped arms. The shape gives it a much s bandwidth than an ordinary dipole.

The cage dipole is a similar modification in which the bandwidth is increased b using fat cylindrical dipole elements made of a "cage" of wires.

The vee or quadrant antenna is a horizontal dipole with its arms at an angle instead of parallel. Quadrant antennas are notable in that they can be used to make horizontally polarized antennas with near-omnidirectional radiation patterns.

G5RV Antenna is a dipole antenna with a symmetric feeder line, which also serves as a 1:1 impedance transformer allowing the transceiver to see the, impedance of the antenna (it does not match the antenna to the 50-ohm transceiver. In fact the impedance will be somewhere around 90 ohms at the resonant frequency but significantly different at other frequencies).

The sloper antenna is a slanted dipole antenna used for long-range communications or in limited space.

For a small hand held or portable system, it is desirable to have an efficient, physically small, UWB antenna structure that radiates non-dispersively and omni-directionally. It is particularly advantageous for an antenna to be easily made in large volumes with reliable repeatable quality. Not only are such antennas unknown to the present art, in fact, the current teaching is that such antennas are not physically realizable.

There is a need for a wideband antenna that is compact, efficiently matched to a feed structure and radiates omni-directionally.

Therefore, there is still a long felt unmet need for a unique antenna design having high efficiency adjacent to a variety applications and requirements for communications.

SUMMARY OF THE INVENTION

It is an object of the present invention to disclose an antenna pattern integrated-on-chip for transmitting and/or receiving sub-terahertz and terahertz (THZ) signals; said antenna pattern comprising: a first conductor having bi-circular structure comprising a first conductive circular lobe having a radius (Rx) and a second circular lobe having a radius (Rc), such that said Rx≥Rc;

a second conductor having a bi-circular structure comprising a first conductive circular lobe having a radius (Rx) and a second circular lobe having a radius (Rc), such that said Rx≥Rc; said second bi-circular conductor connected to said first conductor bi-circular;

said first bi-circular and said second bi-circular characterized by at least one port thereby, having an area of intersection between said first bi-circular and said second bi-circular, forming an ultra-wideband (UWB) frequency response of more than about 100% bandwidth when integrated to a dielectric material.

It is another object of the present invention to disclose the antenna, wherein said antenna is integrated to said dielectric material layer selected from the group consisting of $SiO_2$, Silicon and a combination thereof.

It is another object of the present invention to disclose the antenna, wherein said antenna Rx is the radius of said first circular at X direction.

It is another object of the present invention to disclose the antenna, wherein said first circle lobe is characterized by a radius (Ry) at Y direction.

It is another object of the present invention to disclose the antenna, wherein said second circle lobe is characterized by a radius (Ry) at Y direction.

It is another object of the present invention to disclose the antenna, wherein said first bi-circular and said second bi-circular having at least one overlapping portions such that overlapping area ranges between about 0 to about 100%.

It is another object of the present invention to disclose the antenna, wherein said antenna is with a thickness of about 0.1 μm to 100 μm.

It is another object of the present invention to disclose the antenna, wherein said first conductive circular lobe and said second conductive circular lobe characterized by a distance (d) between the centers of said lobes such that when d=0 the area of the intersection is $\pi Rc^2$, when d≥2Rc the area of intersection is 0.

It is another object of the present invention to disclose the antenna, wherein said circular lobe is an oscillating lobe with a shape selected from the group consisting of: circle, disk, elliptic, conic, spherical, ball-like, cylinder, hoop, loop, ring like, egg like, tube like and any combination thereof.

It is another object of the present invention to disclose the antenna, wherein said antenna is electrically coupled to a CMOS transceiver chip/detector via connectors.

It is another object of the present invention to disclose the antenna as disclosed in any of the above, wherein said antenna radiates in the range of frequencies of about 258 GHz to more than about 2000 GHz, where S11=−9.5 dB, said antenna performance in air dielectric material is more than 120%.

It is another object of the present invention to disclose the antenna as disclosed in any of the above, wherein said antenna radiates in the range of frequencies of about 346 to more than about 3000 GHz, where S11=−9.5 dB, said antenna performance in air dielectric is more than about 150%.

It is another object of the present invention to disclose the antenna as disclosed in any of the above, wherein said antenna radiates in the range of frequencies of about 147 to about 559 GHz, where S11=−9.5 dB, said antenna performance in silicon dielectric structure is about 116%.

It is another object of the present invention to disclose a geometric array of antenna comprising: a matrix of a plurality of antenna patterns for receiving and/or transmitting sub-terahertz and terahertz(THZ) signals; said antenna pattern comprising : a first conductor having bi-circular structure comprising a first conductive circular lobe having a radius (Rx) and a second circular lobe having a radius (Rc), such that said. Rx≥Rc; a second conductor having a bi-circular structure comprising a first conductive circular lobe having a radius (Rx) and a second circular lobe having a radius (Rc), such that said Rx≥Rc; said second bi-circular conductor connected to said first conductor bi-circular; said first bi-circular and said second bi-circular characterized by at least one port thereby, having an area of intersection between said first bi-circular and said second bi-circular, forming an ultra-wideband frequency response of more than about 100% band width.

It is another object of the present invention to disclose the array as disclosed in any of the above, wherein comprising a matrix selected from the group consisting of:

a.4 rows by 4 columns of said antennas;

b.3 rows by 2 columns of said antennas;

c.4 by 4 antennas;

d.3 by 4 antennas with different orientation;

e. and any combination thereof.

It is another object of the present invention to disclose the array as disclosed in any of the above, wherein said geometric array is electrically coupled to a CMOS transceiver chip/detector via connectors.

It is another object of the present invention to disclose the array as disclosed in any of the above, wherein additionally comprising a plurality of antennas having identical structure.

It is another object of the present invention to disclose the array as disclosed in any of the above, wherein additionally comprising a plurality of antennas having different orientations.

It is another object of the present invention to disclose the array as disclosed in any of the above, wherein additionally comprising a plurality of antennas distinct in structure.

It is another object of the present invention to disclose the array as disclosed in any of the above, wherein said circular lobe is an oscillating lobe with a shape selected from the group consisting of: circle, disk, elliptic, conic, spherical, ball-like, cylinder, hoop, loop, ring-like, egg-like, tube-like and any combination thereof.

It is another object of the present invention to disclose the array as disclosed in any of the above wherein said antennas structure selected from the group consisting of biconical antenna, bow tie or butterfly like antennas, lemniscate like shape, log periodic, log spiral, conical spiral antennas, biconical antenna, a dish antenna consisting of the rounded sides of two spherical hemispheres being driven against one another and any combination thereof.

It is another object of the present invention to disclose a method of forming an antenna pattern integrated-on-chip for transmitting and/or receiving sub-terahertz and terahertz (THZ) signals; said method comprising steps of:

providing an antenna pattern comprising first conductor having a bi-circular structure connected to a second conductor having a bi-circular structure; said first bi-circular and said second bi-circular characterized by at least one port thereby, having an area of intersection between said first bi-circular and said second bi-circular; said bi-circular structure comprising a first conductive circular lobe having a radius (Rx) and a second circular lobe having a radius (Rc), such that said Rx≥Rc; and a second conductor having at bi-circular structure comprising a first conductive circular lobe having a radius (Rx) and a second circular lobe having a radius (Rc), such that said Rx≥Rc; and positioning said antenna pattern on top of a dielectric material therefore, forming an ultra-wideband (UWB) frequency response of more than about 100% bandwidth.

It is another object of the present invention to disclose the method as disclosed in any of the above, wherein said antenna is integrated to said dielectric material layer selected from the group consisting of $SiO_2$, Silicon and a combination thereof.

It is another object of the present invention to disclose the army as disclosed in any of the above, wherein said first lei-circular and said second bi-circular having at least one overlapping portions such that overlapping area ranges between about 0 to about 100%.

It is another object of the present invention to disclose the array as disclosed in any of the above, wherein said step of providing said first conductive circular lobe and said second conductive circular lobe characterized by a distance (d) between the centers of said lobes such that when d=0 the area of the intersection is $\pi Rc^2$, when d≥2Rc the area of intersection is 0.

It is another object of the present invention to disclose the array as disclosed in any of the above, wherein said circular lobe is an oscillating lobe with a shape selected from the group consisting of circle, disk, elliptic, conic, spherical, ball-like, cylinder, hoop, loop, ring like, egg like, tube like and any combination thereof.

It is another object of the present invention to disclose the array as disclosed in any of the above, wherein additional comprising steps of electrically coupling said antenna to a CMOS transceiver chip/detector via connectors.

It is another object of the present invention to disclose the array as disclosed in any of the above, wherein said antenna radiating in the range of frequencies of about 258 GHz to more than about 2000 GHz, where S11=−9.5 dB, said antenna performance in air dielectric material is more than 120%.

It is another object of the present invention to disclose the array as disclosed in any of the above, wherein said antenna radiating in the range of frequencies of about 346 to more than about 3000 GHz, where S11=−9.5 dB, said antenna performance in air dielectric is more than about 150%.

It is another object of the present invention to disclose the array as disclosed in any of the above, wherein said antenna radiating in the range of frequencies of about 147 to about 559 GHz, where S11=−9.5 dB, said antenna performance in silicon dielectric structure is about 116%.

BRIEF DESCRIPTION OF THE FIGURES

In order to better understand the invention and its implementation in practice, a plurality of embodiment will now be described, by way of non-limiting example only, with reference to the accompanying drawings, wherein.

DETAILED DESCRIPTION OF THE INVENTION

Figure 1A:
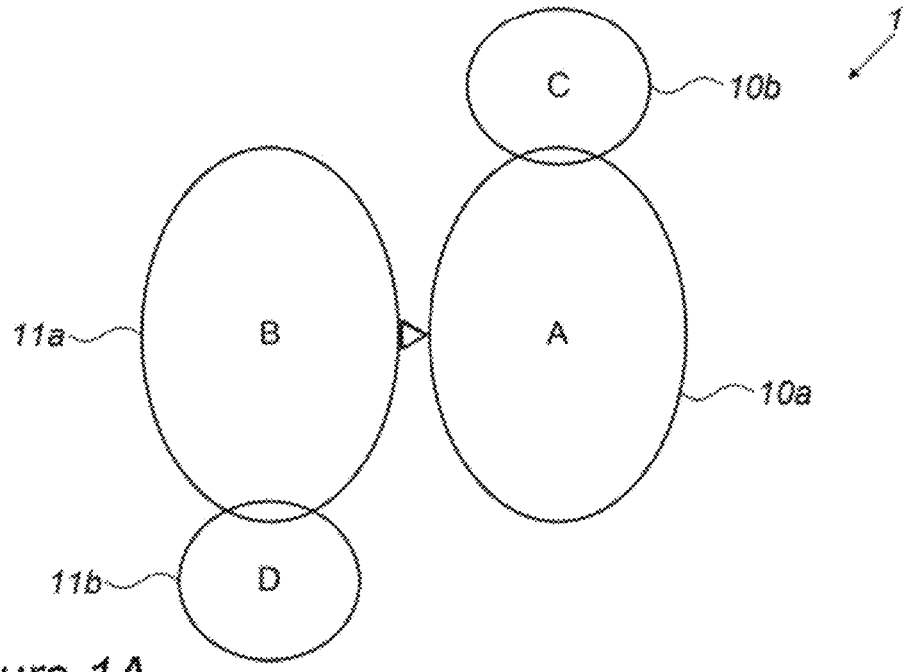
FIGS. 1A-1B show a schematic view of the geometric structure of the antenna, of the present invention.

The following description is provided, alongside all chapters of the present invention, so as to enable any person skilled in the art to make use of the invention and sets forth the best modes contemplated by the inventor of carving out this invention. Various modifications, however, will remain apparent to those skilled in the art, since the generic principles of the present invention have been defined specifically to provide a means and method for an antenna pattern useful for transmitting and/or receiving of electromagnetic energy or signals.

The antenna of the present invention configuration is mainly for transmitting and/or receiving sub-terahertz and terahertz (THZ) signals for impulse radio broadband or and ultra-wideband(UWB) applications.

The term 'Terahertz signals' refers herein to submillimeter radiation, terahertz waves, tremendously high frequency (THF), T-rays, T-waves, T-light, T-lux THz which consists of electromagnetic waves within the ITU-designated band of frequencies from 0.03 to 3 terahertz . Furthermore, Terahertz signals of the present invention are in the terahertz range and the sub-terahertz range which lies between the infrared range and the microwave range.

The antenna structure of the present invention is characterized as a wideband antenna having operating characteristics over a very wide passband.

The present invention provides an antenna structure which may have a planar two-dimension (2D) shape especially for applications requiring extremely wideband frequency transmission and reception and being independent of central frequency. In other embodiment the antenna structure may have a three-dimension (3D) shape.

The antenna of the present invention may be a monopole, quart-pole or a dipole antenna having an interface between radio waves propagating through space and electric currents moving in metal conductors, used with a transmitter or receiver. In transmission, a radio transmitter supplies an electric current to the antenna's terminals, and the antenna radiates the energy from the current as electromagnetic waves (radio waves). In reception the antenna intercepts some of the power of an electromagnetic wave in order to produce an electric current at its terminals, that is applied to a receiver to be amplified. The antennas may be integrated in radio equipment, and may he used in radio broadcasting, broadcast television, two-way radio, communications receivers, radar, cell phones, satellite communications and other devices.

The present invention provides a dipole antenna pattern integrated-on-chip for transmitting and/or receiving electromagnetic signals. The antenna pattern comprising: a first conductor having a bi-circular structure, a second conductor having a bi-circular structure connected to the first bi-circular structure. The bi-circular structure comprising a first conductive circular lobe having a radius (Rx) and a second circular lobe having a radius (Rc), such that Rx≥Rc.

In another embodiment of the present invention, the bi-circular structure comprising a first conductive circular lobe having a radius Rx and optionally Ry on the x and y axes respectively.

In another embodiment of the present invention, the first bi-circular and the second bi-circular characterized by at least one port thereby, having an area of intersection between the first bi-circular and the second bi-circular. This configuration yields an efficiency of more than 100% over a large bandwidth. Therefore, enabling an ultrawideband (UWB) frequency response of more than about 100% band width.

The term "chip is employed herein to describe an integrated circuit or monolithic integrated circuit consisting of a set of electronic circuits on one small flat piece of semiconductor material.

The term "bi-circular" is employed herein to describe a two-dimensional geometric structure of two circles, two ellipses, ellipse and a circle or a combination of any two circular shape lobes.

The two circles may overlap each other of may an intersection with each other.

In its most preferred embodiment, the term "bi-circular" antenna is oriented structure substantially symmetrically about at least one axis. Furthermore, the first bi-circular conductor and second bi-circular conductor are bilaterally symmetrical. A preferred embodiment of an "ovoidal" or "elliptical" element presents a substantially continuously curved it intersection with a gap interface in a plane in an antenna.

The bi-circular antenna is characterized by power, chary directional or bi-directional, efficient, vertically polarized antenna.

The terms "ellipse", "ovoidal", "elliptical", spheroidal, ellipsoid or "elliptic" are employed herein to describe a structure which is a curve in a plane surrounding two focal points such that the sum of distances to the two focal points is constant for every point an the curve.

In other embodiments, three-dimensional element having a generally smoothly curved shape may he further employed to the antenna structure.

The term "circular" is employed herein to indicate a substantially two-dimensional, planar element having a generally smoothly curved shape, In its most preferred embodiment, the term "circular" is with a shape selected from the group consisting of: circle, disk, elliptic shape, conic, spherical shape, hall-like, cylinder, hoop, loop, ring-like, tube like, egg like and any combination thereof.

Its most preferred embodiment, the first bi-circular and the second bi-circular conductor elements present planar sections oriented substantially symmetrically about at least one axis.

The antenna of the present invention comprises an array of conductor elements, electrically connected to a receiver or transmitter. During transmission, the oscillating current applied to the antenna by a transmitter creates an oscillating electric field and magnetic field around the antenna elements. These time-varying fields radiate energy away from the antenna into space as a moving transverse electromagnetic field wave. Conversely, during reception, the oscillating electric and magnetic fields of all incoming radio wave exert force on the electrons in the antenna elements, causing them to move back and forth, forming oscillating currents in the antenna.

As used herein the term "about X" or "approximately X" refers to a range 25% less than to 25% more than of X (X±25%), at times X±20%, X±15% and preferably X±10%.

Figure 1B:
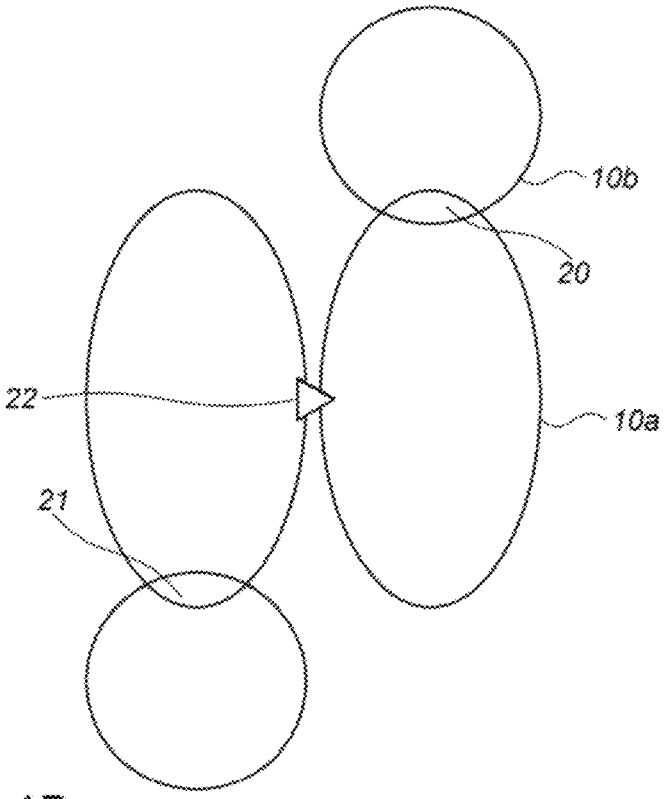

Reference is now made to FIGS. 1A-1B which illustrate a schematic view of a dipole antenna geometric structure of the present invention. The dipole antenna is with a planar geometric structure 1, having two-dimension structure (2D) thereby, emits equal power in all horizontal direction useful for transmitting and/or receiving electromagnetic signals in the Sub-THZ and THZ range. The antenna pattern 1 consists of a first conductor having a bi-circular structure 10*a-b* and a second conductor having a bi-circular structure 11*a-b*. The second conductor having a bi-circular structure 11*a-b* is connected to the first conductor having a bi-circular structure 10*a-b* by having a gap with a predefined distance. The first bi-circular structure comprising a first conductive circular lobe A, 10*a* having a radius (Rx, Ry) and a second circular lobe C, 10*b* having a radius (Rc), such that Rx, Ry≥Rc. The second bi-circular structure comprising a first conductive circular lobe B, 11*a* having a radius (Rx, Ry) and a second circular lobe D, 11*b* having a radius (Rc), such that Rx, Ry≥Rc. Thereby, the first bi-circular structure and the second bi-circular structure are symmetric to each other.

In another embodiment, optionally, the first conductive circular lobe A and/or the second conductive circular lobe B may have an elliptic shape therefore characterized by Rx and Ry on the x and y axes respectively.

In another embodiment, optionally, the first conductive circular lobe C and/or the second conductive circular lobe D may have an elliptic shape therefore characterized by Rex and Rey on the x and y axes respectively.

It is further illustrated that the first bi-circular and second bi-circular characterized by at least one port thereby, having a gap or an area of intersection between the first bi-circular and the, second bi-circular.

This geometric structure enables the antenna to generate an ultra-wideband (UWB) frequency response of more than about 100% bandwidth.

In another embodiment of the present invention, the first conductive circular lobe and the second conductive circular lobe characterized by a distance (d) between the centers of the lobes such that when d=0 the area of the intersection is $\pi R^2$ and when d≥Ry+Rc the area of intersection is 0.

In another embodiment of the present invention, the first bi-circular conductor and the second bi-circular conductor comprising; a ground planes having at least one overlapping portions such that overlapping range is between about 0 to 100%.

As further illustrated in FIG. 1A the first conductor having bi-circular structure and second conductor having a bi-circular structure of comprising the first circle lobe 10*a* having an elliptic shape connected to a smaller circle shape 10*b*, as the second circle lobe. The main parts of the antenna are two conductive elliptically shaped lobes A, B and two additional elliptical conductive lobes C, D in contact with the first elliptical components, respectively.

The elliptical parts A, B, C and D can have any eccentricities. The circle lobes C, D can have a diameter size ranging from 0≤2Rc, 2Rd≤2Rx.

The circle lobes A, B may have a diameter size ranging from 2Rx, 2Ry≤2Rc, 2Rd. in other embodiment, each one of the lobes of the antenna can be independently oriented to each other. The thickness of each antenna parts A, B, C and D can have any required standalone thickness.

The antenna material can be from a conductive material. The overlap between antenna circle lobes (A with C and B with D) can be from contact point to fully contain (C and D are overlapping each other and as a reflection, A and B are overlapping each other, respectively).

The gap (g) between the oscillating lobes A and B of the antenna is an optimization parameter.

FIG. 1B illustrates the first conductor having a bi-circular structure and the second conductor having a bi-circular structure each comprising first and second circle lobes having a structure of two ellipses connecting to each other.

The wideband frequency response is independent of center frequency and the center frequency can vary all over the spectrum of interest. The Antenna structure can have any diameter size to reach the required frequency.

In another embodiment of the present invention, the first conductive circular lobe 10*a* having a radius (Rx) and a second circular lobe 10*b* having a radius (Rc) may have a contact point thereby, intersect in two imaginary points, a single degenerate point, or two distinct points. Therefore, the overlapping area 20, 21 in which the circles intersect may range from about 0%, no overlapping to about 100% of overlapping.

As illustrated in FIG. 1B, the main lobe and side lobe C overlapping each other by approximately less than 50% of each lobe area.

The intersections of two circles determine a radical line. If three circles mutually intersect in a single point, their point of intersection is the intersection of their pairwise radical lines, the radical center.

The antenna pattern as presented in FIG. 1B consists of a first conductor having a bi-circular structure 10*a-b* and a second conductor having a bi-circular structure 11*a-b*. The second conductor having a bi-circular structure 11*a-b* is connected to the first conductor having bi-circular structure 10*a-b* by having a gap 22 with a predefined distance.

Figure 2:
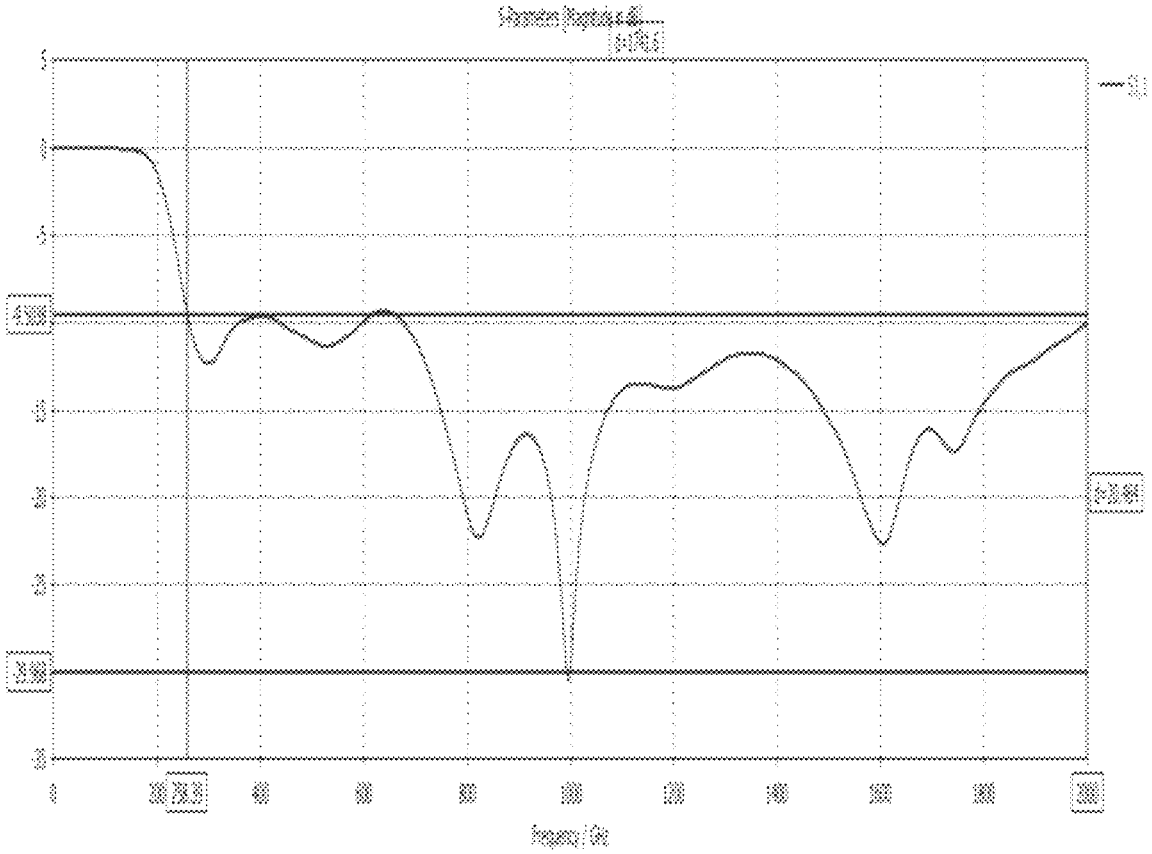
FIG. 2 presents a graph of frequency (GHz) vs. S11 magnitude(dB), of the antenna performance, of the present invention.

Reference is now made to FIG. 2 which presents a graph frequency (GHz) vs, magnitude(dB) of the antenna of the present invention. The graph illustrates the dipole antenna efficiency and performance. The antenna which was tested is having the structure first bi-circular structure connected to a second bi-circular structure, the first and second bi-circular elements includes a first circle lobe having an elliptic shape having intersection with a smaller circle shape(Rx≥Rc), as the second circle lobe.

The antenna of the present invention provides the best performances when any dielectrics material or substrate is not in contact with it. Meaning, standalone antenna in the air is preferred When possible. In case of integrated-on-chip antenna, dielectrics layers or as $SiO_2$, Silicon, PTFE, or any other dielectric material or electrical insulator having high polarizability which is not in the semi-conductor field existing above or below the antenna. The silicon-based antenna is further provided for enhancing the antenna performance, high responsivity and polarization-insensitive photodetection mainly at telecommunication wavelengths.

An example of bandwidth comparison between both cases in ellipse-circular antenna FIG. 1A which has an extremely ultra-wide hand (UWB).

The ellipse-circular antenna which was tested has about 115% Bandwidth(BW) at −9.5 dB in case of integrated-on-chip, while the same shape has more than 150% BW in the air, (optimization can give more WB in both cases) but in the air BW will he greater in any case.

Antenna structure parameters:

Rx: the radius of the ellipse in X direction.

Ry; the radius of the ellipse.

Rc: the radius of the circle C.

Rd: the radius of the circle D.

Gap: the distant between the ellipse main lobs.

Overlap: area of intersection, interlinking of the circles lobs.

As illustrated in the graph of FIG. 2 the antenna radiates best in the range of frequencies of about 258 GHz to more than about 2000 GHz, where S11=−9.5 dB, the antenna performance in air dielectric material is more than 120%. The effectiveness of an antenna is determined by the gain and radiation pattern of the antenna.

Figure 3:
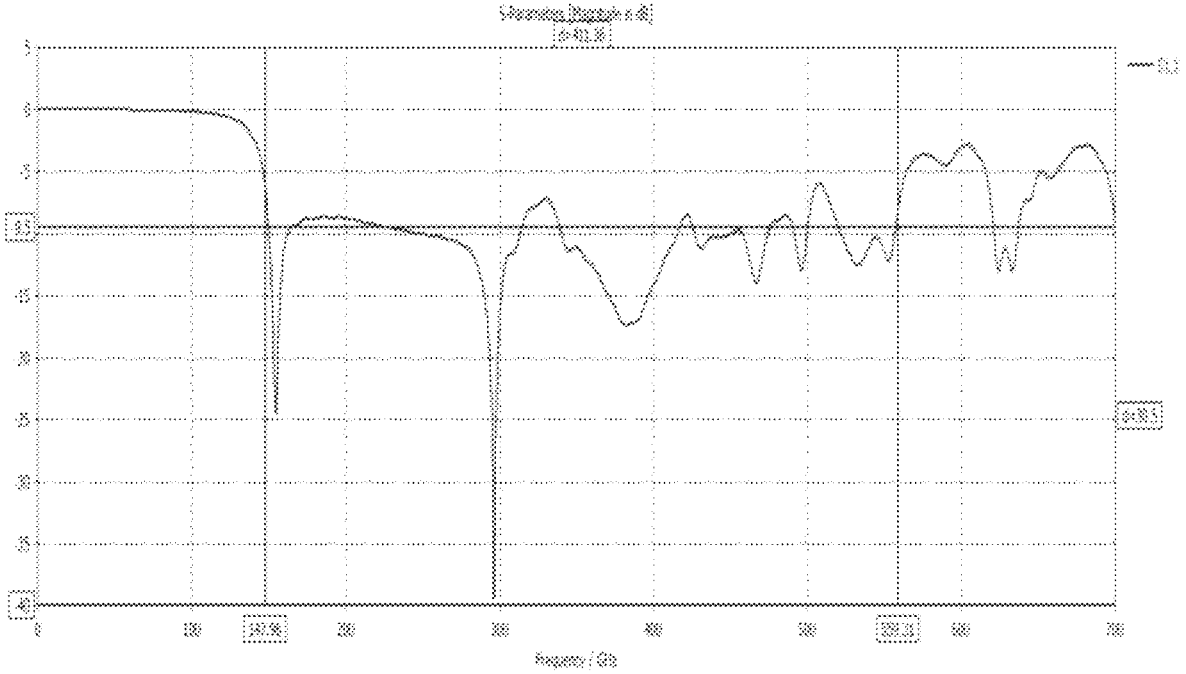
FIG. 3 presents a graph of frequency (GHz) vs. S11 magnitude(dB), of the antenna performance within silicon as a dielectric structure, of the present invention.

Reference is now made to FIG. 3 which presents a graph of the magnitude of an Aluminum antenna of FIG. 1A, having the characteristics presented in Table 1 below, in silicone as a dielectric material.

TABLE 1

| Aluminum Antenna parameter (μ) | | | | | | |
|---|---|---|---|---|---|---|
| Antenna Aluminum Thickness t | Rx ellipse | Ry Ellipse | Rc circle | Gap Ellipse lobs | overlap Ellipse-circle | BW(−9.5dB) On silicon Si = 12.5 S/m |
| 2.8 | 72 | 87 | 0.73*Rx | 5 | 5 | 116% |
| 2.8 | 210 | 270 | 130 | 2 | 9 | 120% |

The graph presents S-parameter result of a half-wave-length dipole antenna designed to operate at about 300 GHz.

As illustrated in the graph of FIG. 3 the antenna radiates best in the range of frequencies of about 147 to about 559 GHz, where S11=−9.5 dB, the antenna performance in a dielectric material or structure such as silicon is about 116%.

Thereby, the antenna of the present invention yields an efficiency of more than 100% over a large bandwidth.

In another embodiment, the parameters size of the antenna can be chosen according to the optimization needs.

Figure 4:
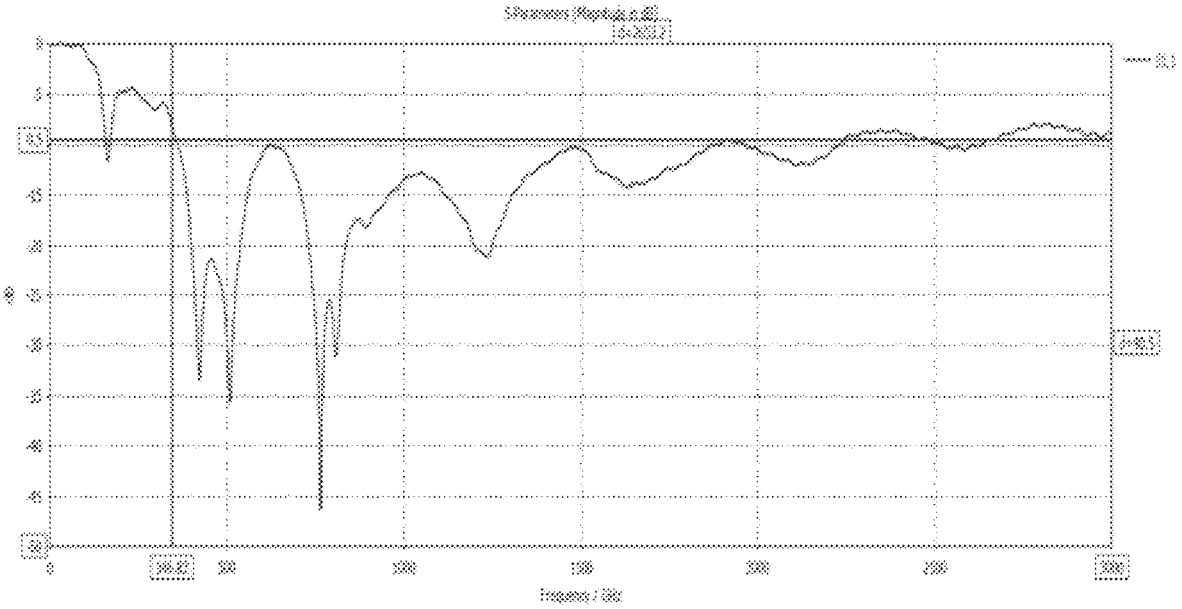
FIG. 4 presents a graph of the frequency (GHz) vs. S11 magnitude(dB) of the antenna performance within air as a dielectric structure, of the present invention.

Reference is now made to FIG. 4 which presents a graph of the magnitude of an Aluminum antenna of FIG. 1A, having the characteristics presented in Table 2 below, in air dielectric material.

TABLE 2

| Aluminum Antenna parameter (μ) | | | | | | |
|---|---|---|---|---|---|---|
| Antenna Aluminum Thickness t | Rx ellipse | Ry Ellipse | Rc Circle | Gap Ellipse | overlap Ellipse-circle | BW(−9.5dB) Air Dielectric |
| 2.8 | 72 | 87 | 0.73*Rx | 5 | 5 | >150% |
| 2.8 | 210 | 270 | 130 | 2 | 9 | >150% |

As illustrated in the graph of FIG. 4 the antenna radiates best in the range of frequencies of about 346 to more than about 3000 where S11=−9.5 dB. Thereby, the antenna performance it air dielectric is more than about 150%.

Thereby, the antenna of the present invention yields an efficiency of more than 100% over a large bandwidth. In another embodiment of the present invention, the antenna of the present invention may be used for a variety of electronic devices, sensors, radars or any chip structure having micron size shape.

In another embodiment of the present in on, the antenna is integrated or printed to a dielectric layer selected from the group consisting of $SiO_2$, Silicon, air and a combination thereof.

In another embodiment of the present invention, the antenna is characterized by a radius Rx of the first circular at X direction and a radius Re of the second circular lobe.

In another embodiment of the present invention, the antenna is characterized by a radius Ry of the first circular at direction.

In another embodiment of the present invention, the antenna is with a thickness of about 0.1 to 100 μ.

In another embodiment of the present invention, the circular lobe is an oscillating lobe with a shape selected from the group consisting of circle, disk, elliptic, conic, spherical, ball-like, cylinder, hoop, loop, ring like, tube like and any combination thereof.

In another embodiment of the present invention, the antenna array of th present Invention, illustrating broadband or/and wideband performance which may further comprise antennas structure selected from the group consisting of biconical antenna, bow tie or butterfly like antennas, lemniscate like shape, log periodic, log spiral, conical spiral antennas, biconical antenna, a dish antenna consisting of the rounded sides of two spherical hemispheres being driven against one another and an combination thereof.

In another embodiment of the present invention, the antenna is an omnidirectional wide-band, directional antenna.

In another embodiment of the present invention, the bicircular antenna of the present invention may comprise a loop shape conductor having a circular shape, elliptical shape or a rectangular shape. The fundamental characteristics of the loop antenna are independent of its shape. They are widely used in communication links with the frequency of around 3 GHz. These antennas can also be used as electromagnetic field probes in the microwave bands. The circumference of the loop antenna determines the efficiency of the antenna as similar to that of dipole and monopole antennas. These antennas are further classified into two types: electrically small and electrically large based on the circumference of the loop.

The antenna of the present invention having a pattern enabling linearly polarized, elliptical or circular polarization.

In another embodiment of the present invention, the antenna is electrically coupled to a CMOS transceiver chip/detector via connectors.

The present invention further provides a system and method of forming a receiving and/transmitting device having a geometric array of a plurality of dipole antennas for accepting sub-terahertz signals and terahertz signals. The receiving and/or transmitting device comprises a die structure formed by a chip manufacturing process with a plurality of dipole antennas on top of a die or in an upper layer of the die.

Figure 5:
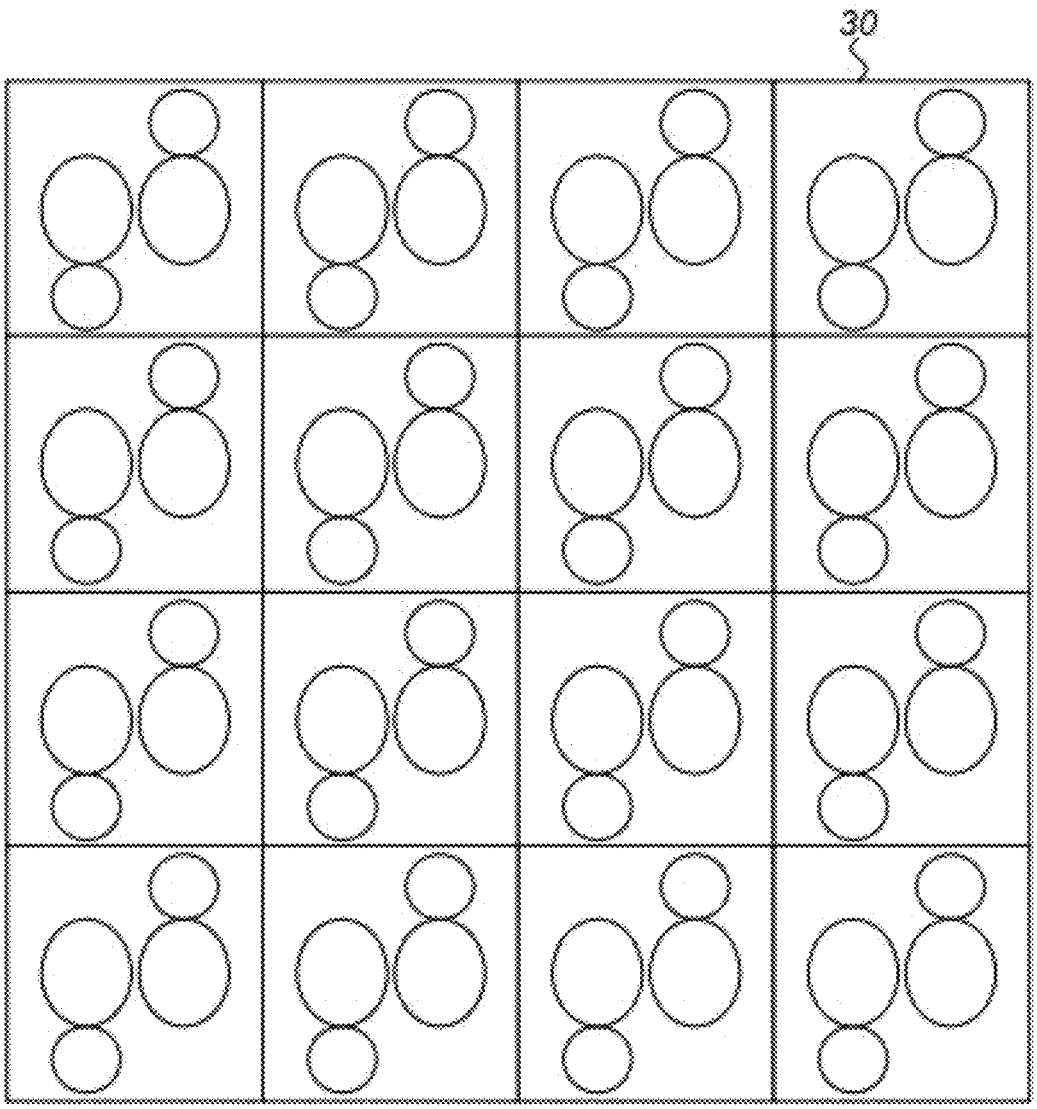
FIG. 5 shows a schematic view of the antenna geometric array, of the present invention; and, FIG. 6 presents a graph of frequency (GHz) vs. S11 magnitude(dB), of the antenna performance within silicon as a dielectric structure, of the present invention.

Reference is now made to FIG. 5 illustrating, a geometric array or/and a predefined matrix configuration, comprising a plurality of antenna pattern elements of the present invention. As illustrated, an array of 16 bicircular antennas 30 whilst each consist of an elliptic lobe connected to a circular lobe), each pixel is 400×400 micron, integrated-on-silicone as the dielectric material.

Figure 6:
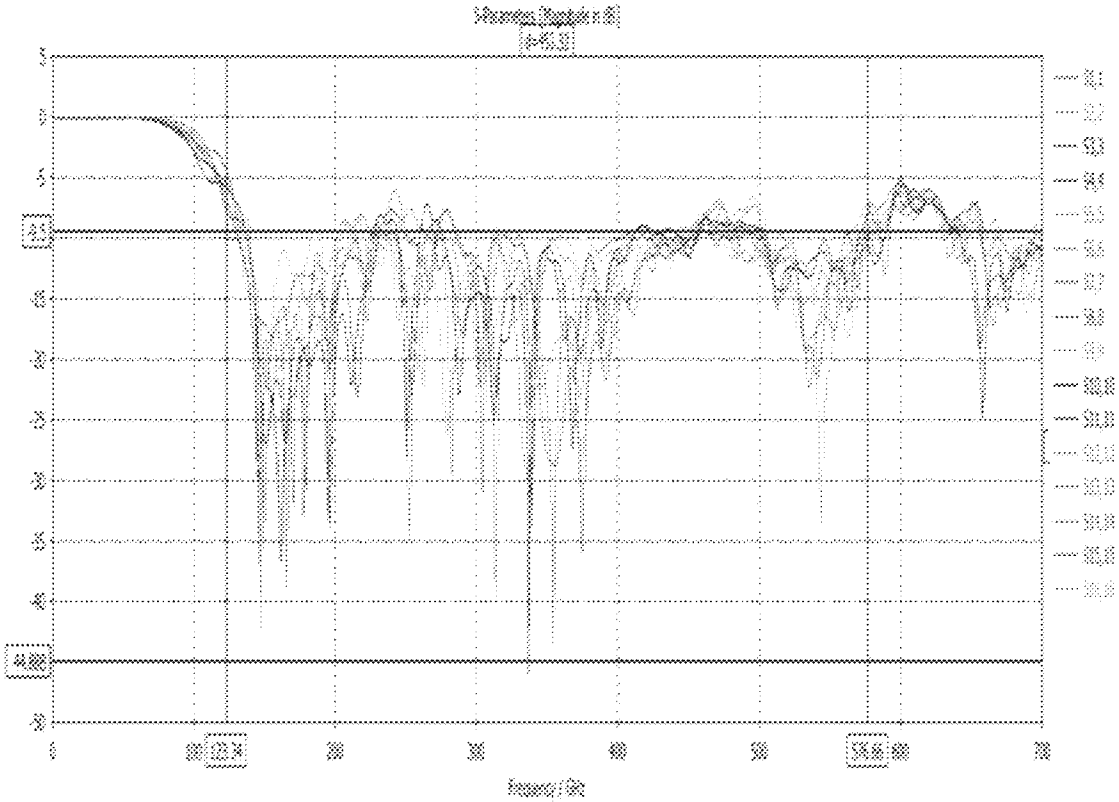

FIG. 6 further presents a graph of S11 magnitude vs. frequency of the 16 antennas array presented in FIG. 6. Frequency band bellow the line of (−9.5) dB from about 123 GHz to about 577 GHz (BW=454) while the center frequency is 350 GHz so 454/350=~1.3, BW~130%. This is ultra-wide-band antenna on silicon dielectric material/substrate.

In other embodiment, additional matrices may include 4 rows key 4 columns of antennas or 3 rows by 2 columns of antennas.

In another embodiment of the present invention, an array of 4 by 4 antennas for receiving a signal or specific polarization or a part of the signal with polarization matching the antennas.

In another embodiment of the present invention, a variety of shaped antennas may be used. In sonic embodiment of the disclosure, all the antennas on the die are of the same shape or alternatively, some are one shape and some are another. Likewise all the antennas on the die may be in the same orientation or some may be in one orientation and some in another.

In another embodiment of the present invention, an array of 3 by 4 antennas with different orientation, for example to receive signals from different directions and/or signals having different polarization, for example horizontal, vertical, circular, right or left.

In some embodiment of the present invention, each antenna is designed for a different wavelength or/and frequency, for example by having a different size antenna. Optionally, this enables a variety of imaging techniques, since each antenna receives a different part of the signal (e.g. different polarization, frequency).

In another embodiment of the present invention, multiple antennas are positioned to form a geometric array. Optionally, all of the antennas are identical. Alternatively, some of the antennas have different orientations. Further alternatively, some of the antennas are distinct. In an exemplary embodiment of the disclosure, each antenna is electrically coupled to the CMOS transceiver or/and transmitter chip/detector by a pair of via connectors. Optionally, the via connectors are located in a hole in the die with a clearance between the via connector and the metal layers in the die. In an exemplary embodiment of the disclosure, the via connectors comprise a stack of metal layers supported by conducting beams between the metal layers. Optionally, the metal shield layer is porous and the pores are filled with the dielectric material of the die. In an exemplary embodiment of the disclosure, the imaging sensor includes a low noise amplifier in the same integrated circuit package as the die. Optionally, the low noise amplifier is positioned under the die. In an exemplary embodiment of the disclosure, the low noise amplifier is positioned upside down under the die. Optionally, the imaging sensor is packaged with a lens shaped top to focus the terahertz signals received by the antennas.

In some embodiments of the disclosure, all the antennas on the die are of the same shape or alternatively, some are one shape and sonic are another. Likewise all the antennas on the die may be in the same orientation or some may be in one orientation and some in another.

In another embodiment of the present invention, each antenna is electrically connected to a transceiver chip/transceiver chip/detector that is positioned in the die below the antennas. Additionally, a metallic shielding layer is formed in the die above the CMOS transceiver chip/detector and below the antennas. A metal coating layer is formed under the die and/or a layer of silver epoxy glue is used under the die to attach a lead frame under the die.

In another embodiment of the present invention, the antenna is a dipole metallic antennas made of a material selected from the group consisting of copper, gold, aluminum, or other metallic material or metal alloys.

In another embodiment of the present invention, the dielectric material or substrate and the heights of the dielectric material and curable filling material are selected so that the dimensions of the antennas correspond to the wavelengths of a specific range of terahertz signals being measured to provide optimal gain fa those wavelengths.

In another embodiment of the present invention, the gain of the bi-circular structure antenna is remarkably stable across the performance frequency band.

The present invention further provides a method of forming an antenna pattern integrated-on-chip for transmitting and/or receiving sub-terahertz and terahertz (THZ) signals, the method comprising steps of: providing an antenna pattern comprising first planar bi-circular structure. The first bi-circular structure to the second bi-circular structure. The first lei-circular and the second bi-circular characterized by at least one port thereby, having an area of intersection between the first bi-circular and the second bi-circular. The bi-circular structure comprising a first conductive circular lobe having a radius (Rx) and a second circular lobe having a radius (Rc), such that Rx≥Rc; and a second bi-circular structure.

The method further comprising steps of positioning the antenna pattern on top of a dielectric material therefore, forming an ultra-wideband (UWB) frequency response of more than about 100% bandwidth.

It is another object of the present invention to disclose the method as disclosed in any of the above, wherein the first bi-circular and the second bi-circular having at least one overlapping portions such that overlapping area ranges between about 0 to about 100%.

It is another object of the present invention to disclose the method as disclosed in any of the above, wherein providing the first conductive circular lobe and the second conductive circular lobe characterized by a distance (d) between the centers of the lobes such that when d=0 the area of the intersection is $\pi Rc^2$, when d≥Ry+Rc the area of intersection is 0.

It is another object of the present invention to disclose the method as disclosed in any of the above, wherein the circular lobe is an oscillating lobe with a shape selected from the group consisting of: circle, disk, elliptic, conic, spherical, ball-like cylinder, hoop, loop, ring like, egg like, tube like and any combination thereof.

It is another object of the present invention to disclose the method as disclosed in any of the above, wherein additional comprising steps of electrically coupling the antenna to a CMOS transceiver chip/detector via connectors.

It is another object of the present invention to disclose the method as disclosed in any of the above, wherein the antenna radiating in the range of frequencies of about 258 GHz to more than about 2000 GHz, where S11=−9.5 dB, the antenna performance in air dielectric material is more than 120%.

It is another object of the present invention to disclose the method as disclosed in any of the above, wherein the antenna radiating in the range of frequencies of about 346 to more than about 3000 GHz, where S11=−9.5 dB, the antenna performance in air dielectric is more than about 150%

It is another object of the present invention to disclose the method as disclosed in any of the above, wherein the antenna radiating in the range of frequencies of about 147 to about 559 GHz, where S11=−9.5 dB, the antenna performance in silicon dielectric structure is about 116%.

The invention claimed is:

1. An antenna arrangement integrated-on-chip for transmitting and/or receiving sub-terahertz and terahertz (THZ) signals and configured for use with a dielectric material, said antenna arrangement comprising:

a first conductor having a first bi-circular structure comprising a first conductive circular lobe having a radius (Rx) and a second circular lobe having a radius (Rc), such that Rx≥Rc;

a second conductor having a second bi-circular structure comprising a first conductive circular lobe having a radius (Rx) and a second circular lobe having a radius (Rc), such that Rx≥Rc;

said second conductor being connected to said first conductor;

said first bi-circular structure and said second bi-circular structure being characterized by at least one port, thereby having an area of intersection between said first bi-circular structure and said second bi-circular structure, forming an ultra-wideband (UWB) frequency response of more than about 100% bandwidth when integrated to the dielectric material, wherein at least one of the following holds true:

a. said antenna arrangement radiates in the range of frequencies of about 258 GHz to more than about 2000 GHz, where S11=−9.5 dB, said antenna performance in air dielectric material is more than 120%;

b. said antenna arrangement radiates in the range of frequencies of about 346 to more than about 3000 GHz, where S11=−9.5 dB, said antenna performance in air dielectric is more than about 150%; and c. said antenna arrangement radiates in the range of frequencies of about 147 to about 559 GHz, where S11=−9.5 dB, said antenna performance in silicon dielectric structure is about 116%.

2. The antenna arrangement according to claim 1, wherein said antenna is configured to be integrated to a dielectric material layer selected from the group consisting of $SiO_2$, Silicon and a combination thereof.

3. The antenna arrangement according to claim 1, wherein at least one of the following holds true:

a. said antenna Rx is the radius of said first circular at X direction;

b. said first circle lobe is characterized by a radius (Ry) at Y direction; and c. said second circle lobe is characterized by a radius (Ry) at Y direction.

4. The antenna arrangement according to claim 1, wherein said first bi-circular and said second bi-circular having at least one overlapping portions such that overlapping area ranges between about 0 to about 100%.

5. The antenna arrangement according to claim 1, wherein said antenna arrangement has a thickness of about 0.1 μm to 100 μm.

6. The antenna arrangement according to claim 1, wherein said first conductive circular lobe and said second conductive circular lobe are characterized by a distance (d) between the centers of said lobes such that when d=0 the area of the intersection is $\pi Rc^2$, when d≥Ry+Rc the area of intersection is 0.

7. The antenna arrangement according to claim 1, wherein said circular lobe is an oscillating lobe with a shape selected from the group consisting of:

circle, disk, elliptic, conic, spherical, ball-like, cylinder, hoop, loop, ring like, egg like, tube like and any combination thereof.

8. The antenna arrangement according to claim 1, wherein said antenna arrangement is electrically coupled to a CMOS transceiver chip/detector via connectors.

9. A geometric array of antenna comprising:

a matrix of a plurality of antenna patterns for receiving and/or transmitting sub-terahertz and terahertz(THZ) signals; said antenna patterns comprising:

a first conductor having bi-circular structure comprising a first conductive circular lobe having a radius (Rx) and a second circular lobe having a radius (Rc), such that Rx≥Rc;

a second conductor having a bi-circular structure comprising a first conductive circular lobe having a radius (Rx) and a second circular lobe having a radius (Rc), such that Rx≥Rc;

said second conductor connected to said first conductor;

said first bi-circular structure and said second bi-circular structure characterized by at least one port, thereby having an area of intersection between said first bi-circular structure and said second bi-circular structure, forming an ultra-wideband frequency response of more than about 100% band width, wherein at least one of the following holds true:

a. said antenna radiates in the range of frequencies of about 258 GHz to more than about 2000 GHz, where S11=−9.5 dB, said antenna performance in air dielectric material is more than 120%;

b. said antenna radiates in the range of frequencies of about 346 to more than about 3000 GHz, where S11=−9.5 dB, said antenna performance in air dielectric is more than about 150%; and c. said antenna radiates in the range of frequencies of about 147 to about 559 GHz, where S11=−9.5 dB, said antenna performance in silicon dielectric structure is about 116%.

10. The geometric array according to claim 9, comprising a matrix selected from the group consisting of:

a.4 rows by 4 columns of said antennas;

b.3 rows by 2 columns of said antennas;

c.4 by 4 antennas;

d.3 by 4 antennas with different orientation;

e. and any combination thereof.

11. The geometric array according to claim 9, wherein said geometric array is electrically coupled to a CMOS transceiver chip/detector via connectors.

12. The geometric array according to claim 9, wherein at least one of the following holds true:

a. the geometric array additionally comprises a plurality of antennas having identical structure;

b. the geometric array additionally comprises a plurality of antennas having different orientations;

c. the geometric array additionally comprises a plurality of antennas distinct in structure; and d. said antennas structure is selected from the group consisting of biconical antenna, bow tie or butterfly like antennas, lemniscate like shape, log periodic, log spiral, conical spiral antennas, biconical antenna, a dish antenna consisting of the rounded sides of two spherical hemispheres being driven against one another and any combination thereof.

13. The geometric array according to claim 9, wherein said circular lobes are oscillating lobes with shapes selected from the group consisting of: circle, disk, elliptic, conic, spherical, ball-like, cylinder, hoop, loop, ring-like, egg-like, tube-like and any combination thereof.

14. A method of forming an antenna pattern integrated-on-chip for transmitting and/or receiving sub-terahertz and terahertz (THZ) signals; said method comprising steps of:

providing an antenna pattern comprising first conductor having a bi-circular structure connected to a second conductor having a bi-circular structure;

said first bi-circular structure and said second bi-circular structure characterized by at least one port, thereby having an area of intersection between said first bi-circular structure and said second bi-circular structure;

said first bi-circular structure comprising a first conductive circular lobe having a radius (Rx) and a second circular lobe having a radius (Rc), such that Rx≥Rc; and said second bi-circular structure comprising a first conductive circular lobe having a radius (Rx) and a second circular lobe having a radius (Rc), such that Rx≥Rc; and positioning said antenna pattern on top of a dielectric material, thereby forming an ultra-wideband (UWB) frequency response of more than about 100% bandwidth, wherein at least one of the following holds true:

a. said antenna pattern radiates in the range of frequencies of about 258 GHz to more than about 2000 GHz, where S11=−9.5 dB, said antenna performance in air dielectric material is more than 120%;

b. said antenna pattern radiates in the range of frequencies of about 346 to more than about 3000 GHz, where S11=−9.5 dB, said antenna performance in air dielectric is more than about 150%; and c. said antenna pattern radiates in the range of frequencies of about 147 to about 559 GHz, where S11=−9.5 dB, said antenna performance in silicon dielectric structure is about 116%.

15. The method according to claim 14, wherein positioning said antenna pattern on top of a dielectric material comprises positioning said antenna pattern on top of a dielectric material layer selected from the group consisting of $SiO_2$, Silicon and a combination thereof.

16. The method according to claim 14, wherein said first bi-circular structure and said second bi-circular structure have at least one overlapping portion such that an overlapping area ranges between about 0 to about 100%.

17. The method according to claim 14, wherein said step of providing said first conductive circular lobe and said second conductive circular lobe characterized by a distance (d) between the centers of said lobes such that when d=0 the area of the intersection is $\pi Rc^2$, when d≥Ry+Rc the area of intersection is 0.

18. The method according to claim 14, wherein at least one of the following holds true:

a. said circular lobes are oscillating lobes with shapes selected from the group consisting of: circle, disk, elliptic, conic, spherical, ball-like, cylinder, hoop, loop, ring like, egg like, tube like, and any combination thereof;

b. the method additionally comprises steps of electrically coupling said antenna to a CMOS transceiver chip/detector via connectors.

19. An antenna arrangement integrated-on-chip for transmitting and/or receiving sub-terahertz and terahertz (THZ) signals and configured for use with a dielectric material, said antenna arrangement comprising:

a first conductor having a first bi-circular structure comprising a first conductive circular lobe having a radius (Rx) and a second circular lobe having a radius (Rc), such that Rx≥Rc;

a second conductor having a second bi-circular structure comprising a first conductive circular lobe having a radius (Rx) and a second circular lobe having a radius (Rc), such that Rx≥Rc;

said second conductor is connected to said first conductor;

said first bi-circular structure and said second bi-circular structure are characterized by at least one port, thereby having an area of intersection between said first bi-circular structure and said second bi-circular structure, forming an ultra-wideband (UWB) frequency response of more than about 100% bandwidth when integrated to the dielectric material, wherein:

in each of the first and second conductors, the first conductive lobe having a radius Rx and the second circular lobe having a radius Rc are in contact and partially overlap, the first and the second conductor are connected by having a gap with a predefined distance, and the first and second conductor are symmetric with respect to each other.

* * * * *